United States Patent [19]

Stanley, Jr.

[11] 3,943,627

[45] Mar. 16, 1976

[54] FRONT LOADING UTILITY KNIFE

[76] Inventor: Conrad Stanley, Jr., Wayne, N.J.

[22] Filed: Nov. 28, 1973

[21] Appl. No.: 419,637

[52] U.S. Cl. ..... 30/151; 30/125; 30/337

[51] Int. Cl.[2] ..... B26B 5/00

[58] Field of Search ..... 30/151, 164, 286, 293, 30/294, 314, 317, 337, 339, 329

[56] References Cited

UNITED STATES PATENTS

| | | | |
|---|---|---|---|
| 515,045 | 2/1894 | Von Bultzingslowen | 30/337 X |
| 1,038,896 | 9/1912 | Jolly | 30/151 |
| 1,289,888 | 12/1918 | Overland | 30/151 |
| 1,384,644 | 7/1921 | Stuller | 30/337 X |
| 1,813,868 | 7/1931 | Smiroldo | 30/293 X |
| 2,321,706 | 6/1943 | Salsbury | 30/151 |
| 2,376,887 | 5/1945 | Walters | 30/151 X |
| 2,601,388 | 6/1952 | Guarino | 30/337 X |
| 2,784,489 | 3/1957 | Reise | 30/151 |
| 2,867,901 | 1/1959 | Warnes | 30/151 |
| 2,967,354 | 1/1961 | Ahlborn | 30/293 X |

FOREIGN PATENTS OR APPLICATIONS

| | | | |
|---|---|---|---|
| 453,293 | 3/1931 | France | 30/337 |
| 435,584 | 10/1926 | Germany | 30/151 |

*Primary Examiner*—Al Lawrence Smith
*Assistant Examiner*—J. T. Zatarga
*Attorney, Agent, or Firm*—Albert F. Kronman

[57] ABSTRACT

A fixed cutting blade is received within one end of a two part housing. An elongated guard having a U-shaped cross section embraces the housing parts at the blade end and is shiftable through a series of positions to expose different amounts of the cutting blade including a blade covering or "safety" position.

9 Claims, 10 Drawing Figures

6
13
11
10
32
31
5
8
47
45
40
49
54
22
31
6

13
42
31
45
44
46
47
36
34
54
22

24
23
10
12
13
25
26
38
37
39
44
46
34
34a
33
49
41
22

49
26
13
41
40
22
25
31
12
33

46
44
25
41
22
43
45
48
47
26
41

FIG. 6
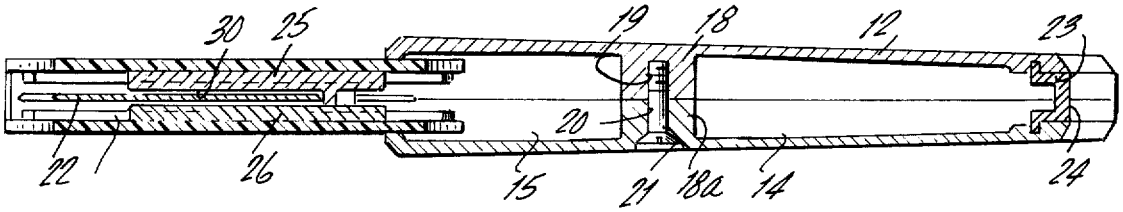
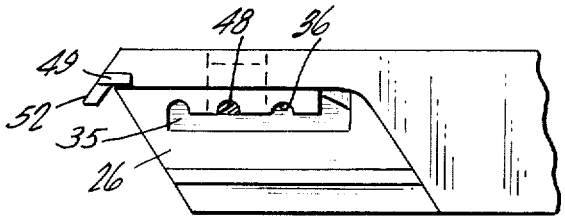
FIG. 7
FIG. 8
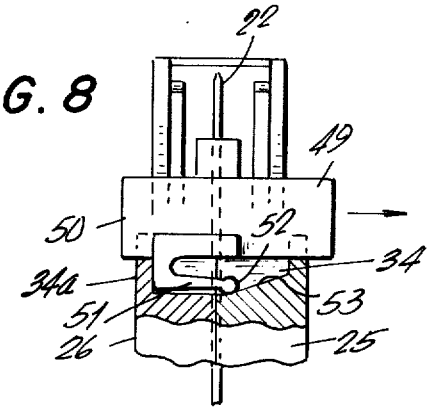
FIG. 9
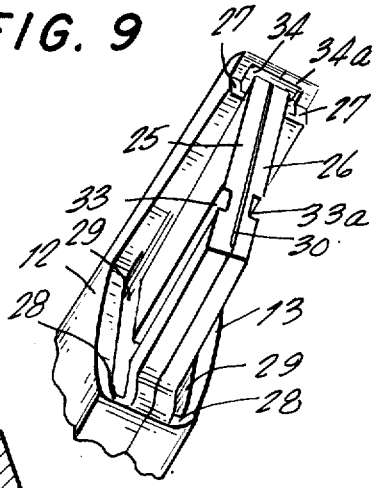
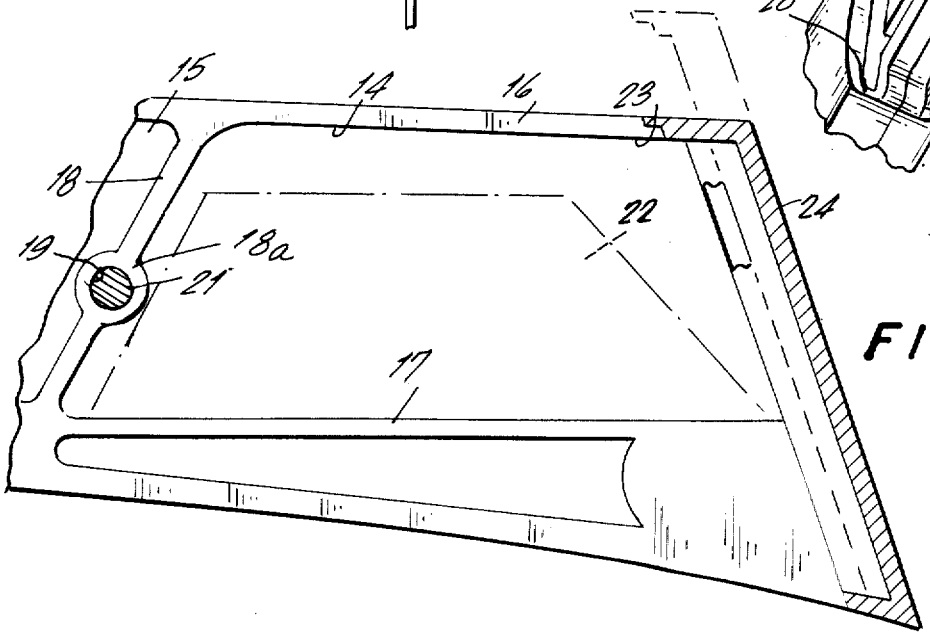
FIG. 10

FRONT LOADING UTILITY KNIFE

BACKGROUND OF THE DISCLOSURE

Utility knives such as are used by workmen in various trades as well as hobbyists are well-known. Such knives generally consist of a handle member and a knife secured to and extending from one end of the handle. The handles of such knives are often longitudinally split to receive the cutting blade therebetween. Bolts, recesses or other means are employed to hold the blade within the handle. The handle must be disassembled at least partially to insert or remove the cutting blade.

The utility knife according to the present invention enables the user to insert or remove the cutting blade from the handle without disassembly of the handle in a minimum amount of time. The cutting blade can be removed and reversed in its position within the handle quickly and safely. A simple guide adjusting button permits the knife user to select the desired amount of cutting edge available and to change the amount of cutting edge according to job requirements. In one position of the guard, the blade is completely covered. Since the blade is fixed within the handle, greater rigidity and safety is achieved.

SUMMARY OF THE INVENTION

In one preferred embodiment of the invention, an elongated handle member consisting of two complimentary left and right hand portions secured together by a screw are formed with spaced plates at one end thereof. A cutting blade is received between the plates and extends outwardly thereof to expose a cutting edge. An elongated guard member having a somewhat U-shaped cross section embraces the plates and underlies the cutting edge of the blade. The guard member is longitudinally shiftable along the plates from an extreme outward position where the cutting edge of the blade is completely covered to one of several inner positions exposing different amounts of blade cutting edge.

DESCRIPTION OF THE DRAWINGS

In the accompanying drawings forming part hereof corresponding parts have been given the same reference numerals, in which drawings:

FIG. 6 is a view in longitudinal section taken on line 6—6 in FIG. 1.

FIG. 7 is a fragmentary view similar to FIG. 2 with the guard and blade removed.

FIG. 8 is a cross sectional view taken on line 8—8 in FIG. 1.

FIG. 9 is a fragmentary isometric view showing the blade supporting portion of the utility knife.

FIG. 10 is a fragmentary view on an enlarged scale of one half of the blade storage end of the utility knife handle partly in section.

GENERAL DESCRIPTION

Figure 1:
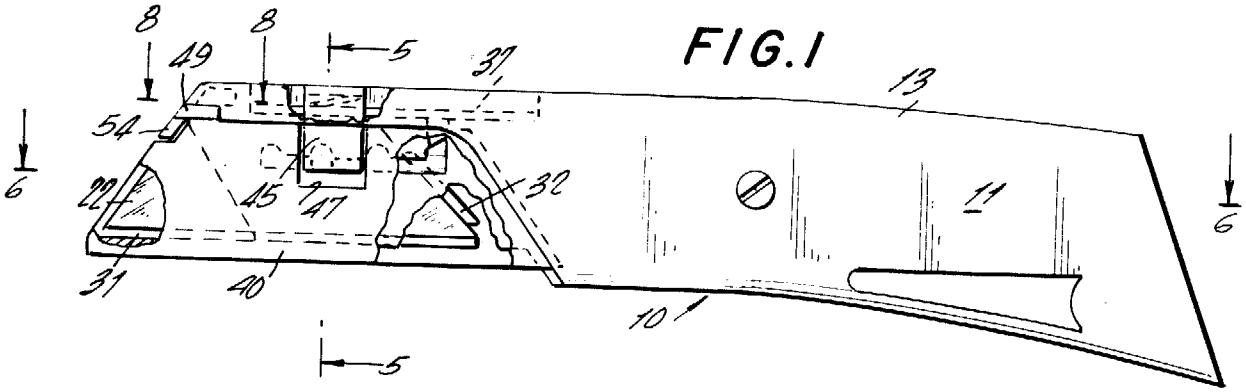
FIG. 1 is a view in side elevation of a complete embodiment of the present invention partially broken away to show the covered blade.
Figure 2:
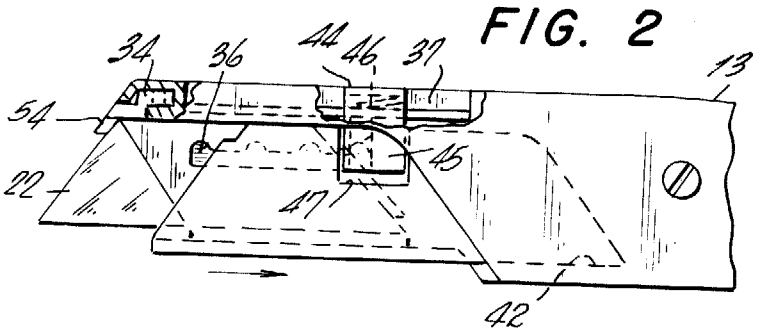
FIG. 2 is a fragmentary view similar to FIG. 1 with the blade guard completely retracted.
Figure 3:
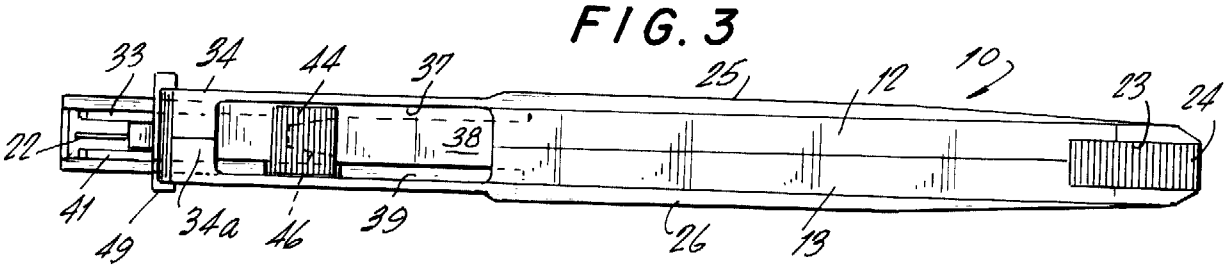
FIG. 3 is a top plan view of the knife shown in FIG. 1

Referring to the drawings and particularly to FIGS. 1, 2 and 3, reference numeral 10 indicates a utility knife having a housing 11. The housing 11 is formed of two mating portions 12, 13 which enclose two chambers 14,15 best shown in FIG. 6. The housing portions enclosing chambers 14,15 form the handle of the knife.

Flanges 16, 17, best shown in FIG. 10, extend inwardly of the handle mating portions and along the tops and bottoms of chambers 14,15. A wall 18, having a threaded bore 19 therein separates the halves of the chambers 14, 15 of the handle portion 12. A wall **18*a*, having a screw receiving bore 20, separates the complimentary halves of the chambers 14, 15 of the handle portion 13. A small screw 21** serves to secure the housing portions together.

The chamber 14 retains one or more spare cutting blades 22 which are accessable through an opening 23 at the handle end of the knife. A plate 24 is slidably received by the opposed walls of the opening 23 to permit the spare blades to be withdrawn when desired.

Each of the housing mating portions 12,13 is formed with an inwardly disposed plate 25,26 at the cutting end thereof. The plates 25,26 are disposed parallel to the longitudinal axis of the utility knife and are secured at their tops and bottoms by flanges 27,28 as best shown in FIG. 9. The inward disposition of the plates 25,26 results in an elongated vertical slot 29 between the outer surfaces of the plates and the inner surfaces of the housing portions 12,13.

The plates 25, 26 have a blade receiving opening 30 therebetween. The plate 25 is provided with a blade supporting surface 31 and a stop 32 extending inwardly of said surface to prevent rearward movement of the blade during use (see FIGS. 1,2). The outer surface of the plate 25 has an elongated longitudinal slot 33 therein for a hereinafter more fully described purpose. A small bracket 34, **34*a* which forms part of a blade retaining assembly is located above the outer end of each of the plates 25, 26 as best shown in FIGS. 8 and 9**.

A longitudinal slot **33*a* is provided in the outer surface of plate 26 opposite the slot 33. The plate 26 is also formed with an elongated guide 35 notched at its top as indicated at 36 in FIG. 7** for a hereinafter more fully described purpose.

An elongated rectangular recess 37 is formed in the top of the housing portions 12, 13, above the plates 25, 26 (see FIGS. 1-3). The bottom of the recess 37 is partially closed by a flat bearing member 38 which is secured to the housing portion 12 and is spaced from the opposed housing portion 13 along one elongated margin leaving an elongated opening 39 therebetween.

A guard 40 having a somewhat U-shaped cross section and inwardly extending ribs 41 is slipped over the plates 25, 26 with the ribs 41 slidably engaging the slots 33, **33*a*. The guard may thus be shifted from the safety of blade covering position shown in FIG. 1 to the blade exposing position shown in FIG. 2. In the position of FIG. 2, the inner ends of the guard slide through the vertical slots 29 between the plates 25, 26 and the housing portions 12, 13. The bottom of the guard is partially cut away, as indicated at 42**, for this purpose.

Figure 5:
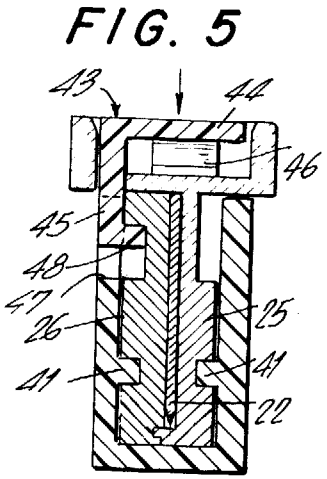
FIG. 5 is a cross sectional view taken on line 5—5 in FIG. 1 looking in the direction of the arrows.

The guard 40 is shifted to its desired positions by a button assembly 43 best shown in FIGS. 1 and 5. The button assembly is formed of plastic or other suitable semi-rigid material having an inverted L-shaped cross-section and in the shape of two flat plates 44, 45 secured together along one of their margins. The plate 44, is freely received within the recess 37 in the top of the knife and its upper surface is serrated or knurled so that it can be adjusted by the thumb of the hand holding the knife without the use of the other hand which may be holding the material being cut. A small flat spring 46, which may be integral with the plate 44, is disposed between the plate and the bottom of the recess 37. The flat spring 46 urges the plate 44 upwardly and away from the bottom of the recess 37.

The depending plate 45 of the button assembly extends through the elongated opening 39 of the recess 37 and into a complimentary cut out portion 47 in the guard 40. A small detent 48, best shown in FIG. 5, extends inwardly of the plate 45 and rides in the guide 35 as the botton assembly is shifted forward and back. When pressure on the plate 44 is released, the flat spring 46 will urge the button assembly upwardly whereupon the detent 48 may be engaged in the nearest notch 36 in the guide 35. The guard 40 which is coupled to the plate 45 is thus retained in the desired position.

Figure 4:
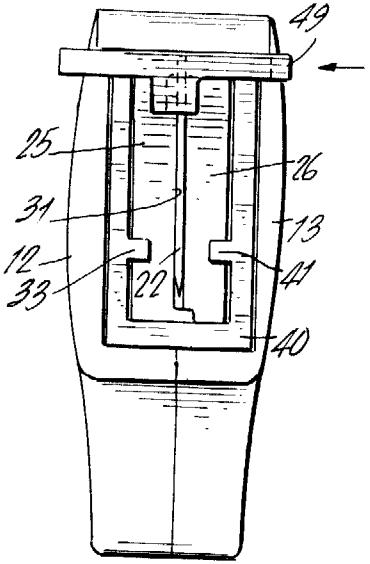
FIG. 4 is a view in front elevation of the knife shown in FIG. 1.

The brackets 34, 34*a* at the top of the cutting end of the housing 11 embrace a small blade retaining latch 49. The latch, best shown in FIGS. 4 and 8, consists of a somewhat flat body portion 50 which is laterally movable within the bracket space. A small spring 51 which may be in the form of a plastic leaf is secured to or integral with the body portion 50. The end of the leaf may be spherical as indicated at 52 in FIG. 8 to reduce friction between the leaf and the rear wall 53 of the bracket 34 against which it bears.

The rear wall 53 slopes rearwardly toward the center line of the knife, (see FIG. 8). As a result, the latch is always urged in the direction of bracket 34*a*. A blade retaining tab 54 is carried upon the front of the latch 49 and depends therefrom so as to overlie the front of the cutting blade 22. The blade 22 is thus prevented from moving out of the opening 30 between the plates 25, 26 during use.

The operation of the utility knife will be apparent from the foregoing description. To place a blade 22 in the cutting position of the knife, it is merely necessary to urge the latch 49 laterally against the spring 51. The tab 54 is thus moved clear of the opening 30 and the blade can be slipped therein, until the blade comes to rest against stop 32. The latch is then released and the blade is locked in place. Next, the guard 40 is slid to its desired location by means of the button assembly 43. The knife is then ready for cutting.

If it is desired to safely store the knife and protect the blade cutting edge, the guard is urged forward into the position of FIG. 1.

The blade 22 shown in the embodiment described above is trapezoidal in shape and the guard 40 is formed accordingly, however, other blade and guard shapes may be employed without departing from the present invention.

Having thus fully described the invention, what is claimed is:

1. A front loading utility knife comprising an elongated hollow housing formed of complimentary first and second mating portions, an inwardly offset plate on each of the mating portions spaced from but parallel to the longitudinal center line of the housing forming an unobstructed front axial cavity therebetween, a cutting blade axially received within the cavity between the offset plates, means carried by at least one of the housing mating portions to limit the travel of the blade between the plates in a rearward direction only, latch means on the housing above the blade constituting the sole element limiting the travel of the blade in a forward direction, a guard slidably carried by the plates and slidable longitudinally for underlying the cutting edge of the blade and a guard positioning assembly for controlling the location of the guard with respect to the blade.

2. A knife according to claim 1 in which the outer surfaces of the offset plates are provided with longitudinal grooves and the inner surfaces of the guard are formed with elongated ribs slidably received within the said grooves.

3. A knife according to claim 1 in which the front of the housing is provided with complimentary bracket members to receive the latch means.

4. A knife according to claim 3 in which the latch means comprises a flat body portion slidably carried by the brackets, spring means to urge the latch means in a normally closed position and a blade retaining tab depending from the body portion and overlying a portion of the front of the blade.

5. A knife according to claim 1 in which at least one of the offset plates is provided with a notched elongated guide to receive the guard positioning assembly.

6. A knife according to claim 2 in which the guard is an elongated member having a somewhat U-shaped cross section, a cut away portion in the bottom thereof opposite the blade and a blade conforming shaped front portion.

7. A knife according to claim 1 in which the guard positioning assembly includes two plate-like members joined together along one margin and normally disposed with respect to each other, one of said plates being horizontally carried by the housing above the inwardly offset plates and the depending plate being coupled to the guard.

8. A knife according to claim 7 in which the depending plate is formed with an inwardly extended detent and the horizontal plate is yieldably urged away from the housing by a spring.

9. A knife according to claim 8 in which the housing is provided with an elongated recess in the top thereof overlying the offset plates, a flat bearing surface in said recess partially covering the bottom portion thereof and an elongated slot in said bottom portion to receive the depending plate therethrough.

* * * * *